US005395215A

United States Patent [19]

Dardis et al.

[11] Patent Number: 5,395,215

[45] Date of Patent: Mar. 7, 1995

[54] SUPPORTS FOR ROTATABLE HOUSING OF LIQUID RING PUMPS

[75] Inventors: Thomas R. Dardis, Stamford; Christopher D. Boczer, Norwalk, both of Conn.

[73] Assignee: The Nash Engineering Company, Trumbull, Conn.

[21] Appl. No.: 280,469

[22] Filed: Jul. 26, 1994

[51] Int. Cl.[6] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,668,532 | 5/1928 | Stewart | 417/68 |
| 2,453,375 | 11/1948 | Kollsman | 417/68 |
| 5,100,300 | 3/1992 | Haavik | 417/68 |
| 5,295,794 | 3/1994 | Haavik | 417/68 |

FOREIGN PATENT DOCUMENTS

| | | | |
|---|---|---|---|
| 587533 | 11/1933 | Germany | 417/68 |
| 1035290 | 3/1982 | U.S.S.R. | 417/68 |
| 1038583 | 3/1982 | U.S.S.R. | 417/68 |
| 1040221 | 5/1982 | U.S.S.R. | 417/68 |
| 1523727 | 11/1989 | U.S.S.R. | 417/68 |

*Primary Examiner*—Richard A. Bertsch
*Assistant Examiner*—Roland G. McAndrews, Jr.
*Attorney, Agent, or Firm*—Fish & Neave

[57] ABSTRACT

A support structure for the rotatable housing of a liquid ring pump includes a stationary structure disposed circumferentially around the housing, and a plurality of rollers rotatably and removably mounted on the stationary structure. The rollers support the housing for rotation, and they are distributed axially along and circumferentially about the housing so that any one roller can be removed (e.g., for repair or replacement) without disturbing operation of the pump.

7 Claims, 1 Drawing Sheet

SUPPORTS FOR ROTATABLE HOUSING OF LIQUID RING PUMPS

BACKGROUND OF THE INVENTION

This invention relates to liquid ring pumps, and more particularly to structures for supporting the rotatable housings of liquid ring pumps having such housings.

Liquid ring pumps with rotatable housings are well known as shown, for example, by such references as Stewart U.S. Pat. No. 1,668,532 and Kollsman U.S. Pat. No. 2,453,375. In such pumps a rotor having a plurality of circumferentially spaced, radially and axially extending blades is disposed in the hollow, annular housing. The rotor rotates about its central longitudinal axis. The rotor axis is parallel to but laterally spaced from the longitudinal axis of the housing. The housing is rotatable about the housing axis. The housing contains a quantity of pumping liquid (usually water). Rotation of the rotor causes the rotor blades to engage the pumping liquid and to form that liquid into a recirculating, hollow annulus or ring inside the housing. Because the rotor is eccentric to the housing, the radially inner surface of the liquid ring between any two circumferentially adjacent rotor blades alternately moves toward and away from the rotor axis as the rotor rotates. Where the inner surface of the liquid ring is moving away from the rotor axis, the pump can pull gas into the expanding volume bounded by the circumferentially adjacent rotor blades and the inner surface of the liquid ring. Where the inner surface of the liquid ring is moving toward the rotor axis, the pump compresses the gas in the contracting volume bounded by the adjacent rotor blades and the inner surface of the liquid ring. Gas is admitted to the pump where the above-mentioned volumes or pumping chambers are expanding. Compressed gas is discharged from the pump where the above-mentioned volumes or pumping chambers have contracted by the desired amount. A principal reason for providing a rotatable rather than a stationary housing is to reduce fluid friction losses between the rotating liquid and the housing.

As an alternative to a full rotating housing, it is known to provide liquid ring pumps with a stationary housing having a rotating liner inside the housing. Structures of this kind are shown, for example, in German patent 587,533 and in Russian patents 1,035,290, 1,038,583, 1,040,221, and 1,523,727. The rotating liner helps reduce fluid friction losses between the rotating liquid and the housing.

Various means are known for supporting such liners for rotation relative to the housing. For example, it is known to use ball bearings as shown in German patent 587,533 and in Russian patents 1,035,290 and 1,523,727. It is also known to use a liquid bearing as shown, for example, in Haavik U.S. Pat. No. 5,100,300 or a gas bearing as shown in Haavik U.S. Pat. No. 5,295,794.

Each of these types of liner bearing structures may have certain disadvantages in some applications. For example, ball bearings have only a relatively small bearing surface and so tend to cause relatively high stress and high wear rates where they contact the outer surface of the liner unless the liner is made of a relatively expensive, high grade material. Liquid and gas bearings, on the other hand, tend to require a fairly precisely controlled clearance between the liner and the housing. This tends to increase the manufacturing cost of the pump. Such structures may also be somewhat sensitive to any contamination of the liquid or gas bearing medium. The liner may cease to rotate if the bearing medium becomes contaminated.

The known structures for supporting rotating housings also tend to have various disadvantages. The most common types of housing supports are bearings of the type shown in Stewart U.S. Pat. No. 1,668,532 which are axially spaced from the main body of the housing. In general, these bearings are difficult or impossible to service without stopping and substantially disassembling the pump. This is undesirable because in many applications liquid ring pumps are needed to provide uninterrupted service for very long periods of time (e.g., in support of other complex and expensive operations such as papermaking machinery which should not have to be interrupted because the liquid ring pump needs service). Somewhat more unusual rotatable housing support structures are shown in Kollsman U.S. Pat. No. 2,453,375. There the rotatable housing is supported by a flexible belt or by a pair of spaced rollers. Again, however, these support structures are impossible to repair or replace without stopping the pump.

In view of the foregoing, it is an object of this invention to provide improved support structures for the rotating housings of liquid ring pumps.

It is a more particular object of this invention to provide support structures for the rotating housings of liquid ring pumps, which support structures can be more easily maintained (including repair and replacement of various bearing components) without stopping or significantly disassembling the pump.

SUMMARY OF THE INVENTION

These and other objects of the invention are accomplished in accordance with the principles of the invention by providing a stationary support structure around the rotating housing of a liquid ring pump, which support structure rotatably supports a relatively large number of rollers that are in rolling contact with a substantially cylindrical outer surface of the housing. The rollers are distributed axially along and circumferentially about the cylindrical housing surface. Each roller is mounted on the support structure so that it is removable from the support structure radially outward from the housing. The number and distribution of the rollers are such that any one roller can be removed (e.g., for repair or replacement) without stopping the pump or the rotation of the housing. While any one roller is thus removed, the remaining rollers continue to fully support the housing.

Further features of the invention, its nature and various advantages will be more apparent from the accompanying drawings and the following detailed description of the preferred embodiments.

DETAILED DESCRIPTION OF THE PREFERRED EMBODIMENTS

Because liquid ring pumps with rotating housings are so well known, it will not be necessary here to depict or describe in detail the typical construction and operation of such apparatus. The prior art documents mentioned above may be referred to for such information, and so those documents are hereby incorporated by reference herein for that purpose. Only the structure necessary for understanding the present invention is shown in the accompanying drawings and described herein.

Figure 2:
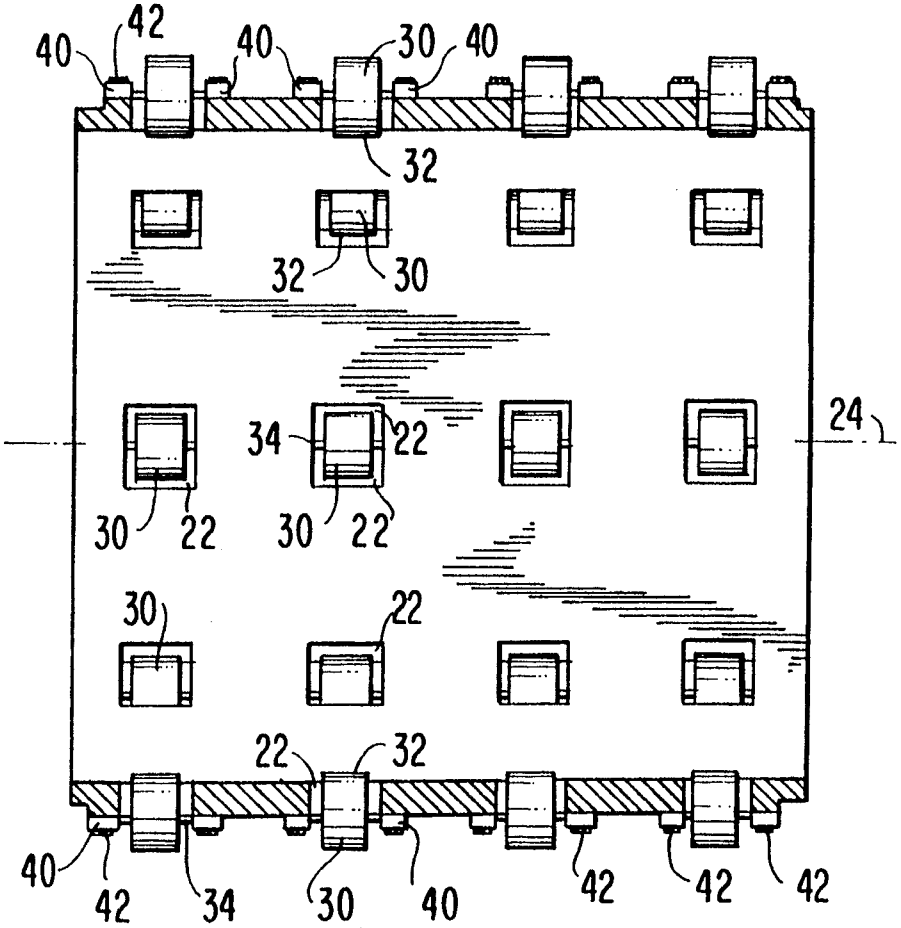
FIG. 2 is a simplified sectional view taken along the line 2—2 in FIG. 1.
Figure 1:
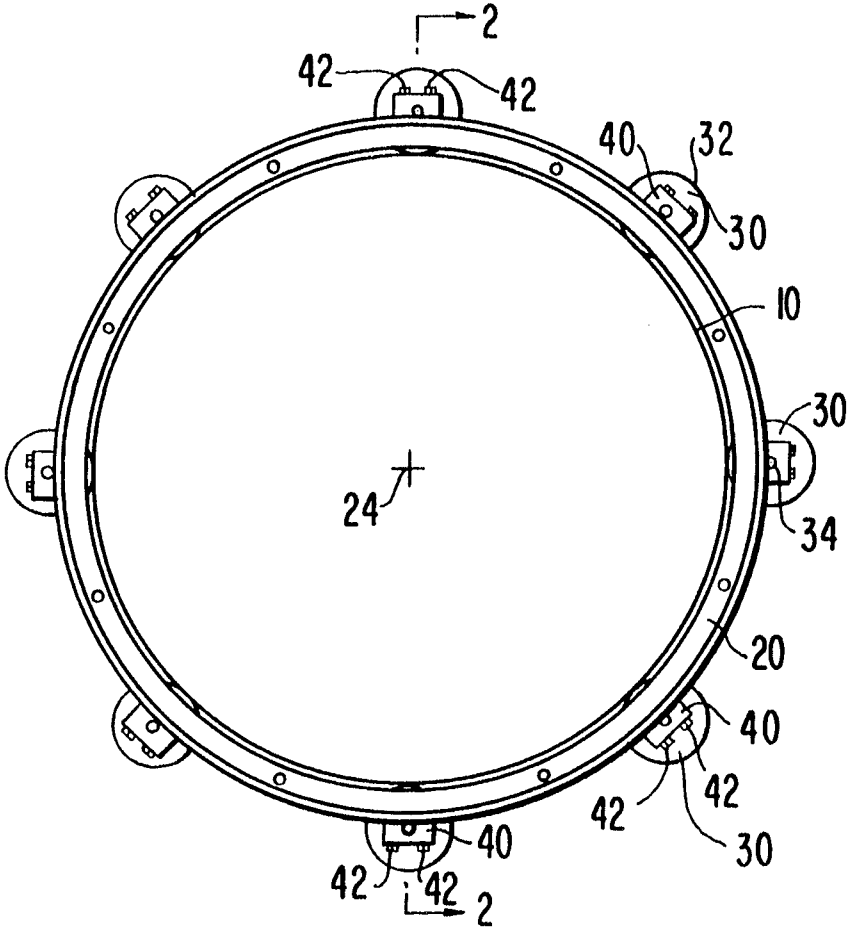
FIG. 1 is a simplified elevational view of an illustrative embodiment of the invention.

In the illustrative embodiment shown in FIGS. 1 and 2 the substantially cylindrical outer surface of the rotatable housing of a liquid ring pump is shown at 10. Housing surface 10 is surrounded by a stationary, annular support structure 20. In this embodiment support structure 20 is a hollow cylindrical member, although it will be appreciated that support structure can alternatively take many other forms.

Support structure 20 has a relatively large number of apertures 22 extending through it from its inner cylindrical surface to its outer cylindrical surface. Apertures 22 are distributed axially along and circumferentially about support structure 20. (The "axis" or "longitudinal axis" of support structure 20 is shown at 24 and coincides with the rotational axis of housing surface 10.) In the particular embodiment shown in FIGS. 1 and 2 apertures 22 are distributed on support structure 20 in eight axially extending rows of four apertures each. These eight rows of apertures 22 are equidistantly spaced around the circumference of support structure 20. It will be understood, of course, that many other numbers of apertures 22 and many other distributions of apertures 22 are possible. For example, although in FIGS. 1 and 2 the apertures in the several rows all line up with one another around support structure 20, the rows could be axially offset from one another to more widely distribute any wear on housing surface 10.

A roller 30 is rotatably mounted on support structure 20 in each of apertures 22. The rotational axes of all of rollers 30 are substantially parallel to axis 24. Each roller 30 has a substantially cylindrical outer bearing surface 32 which is in rolling contact with housing surface 10. Rollers 30 therefore support housing surface 10 for rotation about axis 24 relative to support structure 20.

Each roller 30 is rotatably mounted on a shaft 34 (e.g., by roller or ball bearings (not shown) between the roller and the shaft). Each axial end of each shaft 34 extends into a mounting block 40. Each mounting block 40 is removably secured to the outer surface of support structure 20 (e.g., by a pair of bolts 42 which extend through each mounting block 40 into support structure 20).

From the foregoing it will be apparent that while the liquid ring pump is operating and while pump housing surface 10 is therefore rotating about axis 24, any one of rollers 30 can be removed from the pump structure (e.g., for maintenance, repair, or replacement of that roller). There is a sufficient number of other, suitably distributed rollers 30 to continue to support housing surface 10 for rotation. Any roller 30 can be removed radially outward from support structure 20 by removing the bolts 42 through the associated mounting blocks 40. This ability to remove rollers 30 radially outward helps make it possible to remove the rollers without interrupting or disturbing operation of the pump. Any roller that has been removed (or a replacement for such a roller) can be remounted on the pump by reversing the roller-removal operation. Again this can be done without in any way disturbing the operation of the pump.

It will be understood that the foregoing is only illustrative of the principles of the invention, and that various modifications can be made by those skilled in the art without departing from the scope and spirit of the invention. For example, such parameters as the number of rollers and the axial and angular placement of the rollers can be varied depending on such factors as the type of liquid ring pump and the magnitude of the load which the housing places on the support structure. As another illustration of modifications within the scope of the invention, rollers 30 may be removably mounted on support structure 20 in ways other than the particular way shown in FIGS. 1 and 2. For example, instead of being journaled to the associated shaft 34, each roller may be fixed to its shaft, with the axial ends of the shaft then being journaled to the associated mounting blocks 40.

The invention claimed is:

1. A support for a substantially cylindrical, radially outer surface of a housing of a liquid ring pump comprising:

a stationary support structure adjacent to but spaced radially outward from said housing surface;

a plurality of substantially cylindrical rollers distributed axially along said housing surface and circumferentially around said housing surface, each of said rollers having a substantially cylindrical, radially outer bearing surface; and a mounting for rotatably mounting each of said rollers on said support structure so that a longitudinal axis of each roller is substantially parallel to a longitudinal axis of said housing and the bearing surface of each roller is in contact with said housing surface in order to rotatably support said housing relative to said support structure, each of said mountings permitting the removal and replacement of an associated roller without the need to alter the relative positions of said housing and said support structure, the number and distribution of said rollers being sufficient to allow said removal and replacement of at least one of said rollers while the remainder of said rollers continue to rotatably support said housing relative to said support structure.

2. The apparatus defined in claim 1 wherein each of said mounting means mounts the associated roller on a radially outer surface of said support structure.

3. The apparatus defined in claim 1 wherein each of said mountings allows the associated roller to be removed radially outward from said housing surface.

4. The apparatus defined in claim 1 wherein said support structure is substantially annular about said housing surface.

5. The apparatus defined in claim 4 wherein each roller extends through an associated aperture in said support structure.

6. The apparatus defined in claim 1 wherein each of said mountings comprises:

a shaft extending through the associated roller; and means for removably securing each axial end of the shaft to said support structure.

7. The apparatus defined in claim 5 wherein each of said means for removably securing comprises:

a member for receiving the associated axial end of the shaft; and a bolt for bolting said member to said support structure.

* * * * *

UNITED STATES PATENT AND TRADEMARK OFFICE

CERTIFICATE OF CORRECTION

PATENT NO. : 5,395,215

DATED : March 7, 1995

INVENTOR(S) : Thomas R. Dardis and Christopher D. Boczer

It is certified that error appears in the above-indentified patent and that said Letters Patent is hereby corrected as shown below:

| Column | Line | |
|---|---|---|
| 4 | 61 | Change "5" to --6--. |

Signed and Sealed this

Ninth Day of April, 1996

Bruce Lehman

*Attest:*

BRUCE LEHMAN

*Attesting Officer*

*Commissioner of Patents and Trademarks*